US005709057A

United States Patent [19]

Johnson, Jr. et al.

[11] Patent Number: 5,709,057

[45] Date of Patent: Jan. 20, 1998

[54] POST CAP AND ACCESSORY ASSEMBLY

[76] Inventors: Anderson Forbes Johnson, Jr., HCR-1, Box 445A, Deltaville, Va. 23042; Michael Lee Johnson, 3705 Genesee Ct., Virginia Beach, Va. 23456-5708; William Eric Johnson, Sr., General Delivery, Bavon, Va. 23013

[21] Appl. No.: 508,160

[22] Filed: Jul. 27, 1995

[51] Int. Cl.[6] ..... E04H 12/32

[52] U.S. Cl. ..... 52/301; 52/27; 248/219.2; 248/224.51

[58] Field of Search ..... 52/301, 27, 40, 52/300; 248/219.2, 219.1, 218.4, 224.51, 223.41

[56] References Cited

U.S. PATENT DOCUMENTS

| | | | |
|---|---|---|---|
| D. 299,821 | 2/1989 | Dively | D13/3 |
| 956,656 | 5/1910 | Weinlig . | |
| 971,226 | 9/1910 | Turner | 248/219.2 |
| 2,450,345 | 9/1948 | Kervin | 20/100 |
| 2,664,977 | 6/1954 | Starcevich | 52/301 |
| 2,989,789 | 6/1961 | Cohn | 20/100 |
| 3,240,475 | 3/1966 | Vegh | 52/301 |
| 3,292,319 | 12/1966 | McCarthy | 52/101 |
| 3,319,332 | 5/1967 | Finger et al. | 29/450 |
| 3,498,576 | 3/1970 | Alissandratos | 248/219.2 X |
| 3,928,894 | 12/1975 | Bury et al. | 248/223.41 X |
| 4,110,943 | 9/1978 | Carlson | 52/101 |
| 4,161,090 | 7/1979 | Watts, Jr. | 52/301 |
| 4,245,931 | 1/1981 | Watts, Jr. | 52/301 |
| 4,748,778 | 6/1988 | Rafter, Sr. | 52/101 |
| 5,435,511 | 7/1995 | Hsu | 248/224.51 X |

*Primary Examiner*—Michael Safavi

[57] ABSTRACT

A post cap and accessory assembly for pilings, poles and posts for preventing piling degradation while providing a mounting platform is provided. The cap is attached to a piling using spring clips for quick attachment, or it may be secured by nails or screws. Winged pedestals are provided on top of the cap and around the periphery of the cap's skirt to allow for the ease of attachment of many accessories. Each accessory is equipped with a grooved base that slides onto the winged pedestals and self-locks. The cap and its pedestals are of homogeneous construction formed simultaneously by plastic injection molding, metal casting or other means. All top and side accessories are attached without violating the integrity of the cap so that it remains completely waterproof. An alternate embodiment provides a dual-purpose rope cleat and mounting fixture in place of the top-mounted winged pedestal. The rope cleat and mounting fixture also accepts accessories in a manner similar to the winged pedestal.

8 Claims, 10 Drawing Sheets

POST CAP AND ACCESSORY ASSEMBLY

FIELD OF THE INVENTION

The invention is related to the field of marine pilings and in particular to protective caps for pilings.

BACKGROUND OF THE INVENTION

There are millions of pier pilings, power poles and sign posts in use all subject to adverse environmental conditions. It is well known that various means must be used to prevent degradation to pilings, poles and posts. Virtually every prior effort has addressed the need for a top covering to prevent the entry of water into the end grain of the piling where initial rot typically begins. Most of these coverings require the use of nails, screws or similar techniques to attach the protection to the top of the piling.

The use of nails, screws and other similar fasteners results in a break in the protective seal of the covering. Additionally, the use of these types of fasteners, through the covering, breaches the sealed surface of the piling thereby allowing access for water and freezing damage. Further, it is often necessary to attach some accessories to a post or piling. These attachments typically also breach the cap or cover and sealed surface of the piling.

A need exists for a means of attaching both the cap and any accessories or fixtures attached to the cap without having nails or screws penetrating the upper portions of the cap and without penetrating the upper sealed surface of the piling. Further, a need exists for a means to easily remove or detach accessories from pilings or poles when replacement or modification of purpose is required.

SUMMARY OF THE INVENTION

Accordingly, it is an object of the present invention to provide a post cap and accessory assembly having a means for attachment to a post which maintains the integrity of the top surfaces of both the cap and the underlying piling.

It is another object of the invention to provide a cap having a means for easy removal.

It is yet another object of the invention to provide a post cap having a means for attaching and detaching accessories required in the use of a post and maintaining cap surface integrity while attaching and detaching accessories.

The present invention overcomes the above-mentioned problems of prior art and was developed with the realization that a piling cap could serve not only as a protective cover but also as a foundation for mounting many items normally associated with marine and dockside activities. Typical accessorial items are pennants, flags, spikes (to prevent roosting of sea gulls), solar lamps, weathervanes, wind socks, plastic birds of prey, rope guide blocks for forming a rope railing from piling to piling, alphanumeric frames, reflectors, hooks for rope, life preservers and water hoses, flower pots, drink holders and rope cleat blocks for keeping boat lines out of the water.

The preferred embodiment of the cap provides a slightly winged square shaped pedestal on top of the cap so that any accessory equipped with a matching grooved base may be slidably mounted onto the pedestal. Similarly, a plurality of winged pedestals are located on the exterior of the cap skirt. These pedestals are different in shape and size from the top pedestal so they will accept only accessories functionally appropriate for side mounting when those accessories are equipped with the side mounting grooved base. All accessory bases for both top and side mounting are provided with a feature which self-locks the assembly together when the base is fully engaged with the pedestal. Each lock is equipped with a pull tab to release the lock, thereby allowing the removal of an accessory. However, an option for the owner is to cut off the pull tab to deter theft. The owner can still remove the accessory by prying open the locking feature with a small tool such as a screwdriver.

The cap may be mounted by using nails or screws through grommet reinforced holes drilled into the bottom or lower portion of the cap skirt. A more expeditious mounting technique for the cap has been developed in this invention where windows are provided circumferentially around the cap skirt for the installation of individual spring clips. A cap so equipped with spring clips may be pushed downward onto the top of a piling. The clips prevent any tendency for the cap to rock and aid in the adaptability of a cap to an out-of-round piling. Typical TINNERMAN® style clips of stainless steel as manufactured by Eaton Corporation may be used. While ordinary spring clips allow for the quick mounting of a cap to a piling, ordinary clips offer a possible disadvantage. Once a cap with ordinary spring clips is firmly set in place on a piling no further adjustment of the cap's rotary position or attitude may be made. Therefore, a further development of this invention is to provide a spring clip that is equipped with a pull ring. The pull ring is attached by a flexible strip to the main holding tang of the spring clip. Located intermediately between the tang and ring is a nodular ball significantly greater in diameter than the strip so that the holding tang may be pulled into a released position and held. Thus, when the strip is pulled into a narrow notch in a window in the cap skirt, it is held in place by the ball. This feature allows repetitive repositioning or removal of the cap to satisfy the owner's preferences. For permanent installation, the owner may cut the pull ring-strip from the tang thereby helping to prevent theft.

An alternate embodiment combines the cap cover and one of the primary accessories, the top-mounted rope cleat, into a single integral unit. The rope cleat itself is then used as a multi-purpose base for attachment of other top-mounted accessories.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

The invention comprises an integral protective piling cap having a means for attaching accessories to the top and sides. A preferred embodiment of the invention comprises an injection molded cap of a high strength plastic such as, a copolymer of polycarbonate/polyterephthalate as manufactured by General Electric Company under the tradename XENOY®. The plastic includes additives and stabilizers to prevent weathering and ultraviolet degradation. Alternatively, the protective piling cap may be fabricated using metal casting of a non-corroding metal, such as aluminum.

Figure 1:
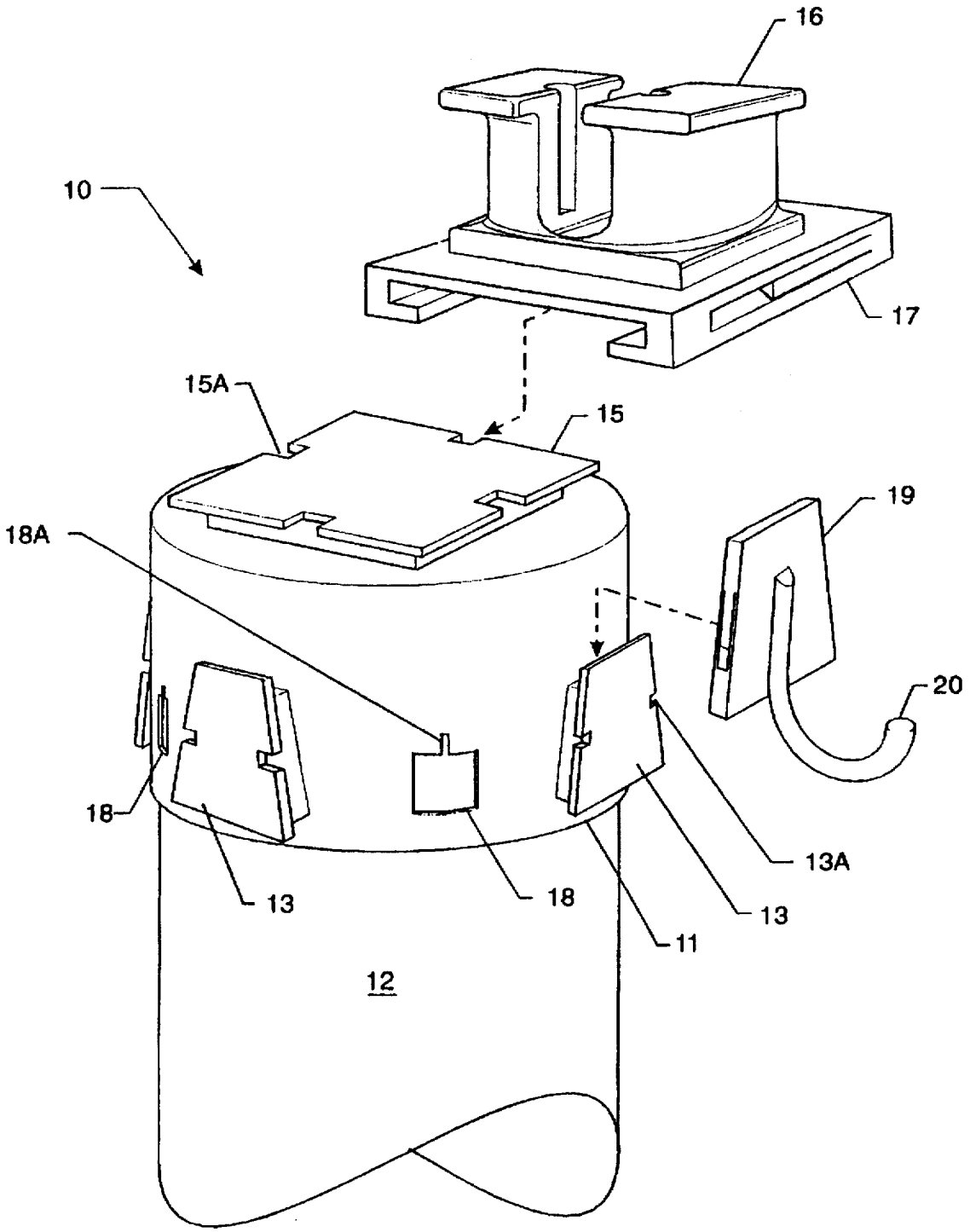
FIG. 1 is an exploded view of the post cap assembly with selected accessories.

Referring now to FIG. 1, a protective cap and accessory assembly, designated generally by the reference numeral 10, is shown with selected components. A major component of the cap assembly 10 is a protective cap 11 shown here mounted on a representative piling 12. The protective cap 11 has a plurality of side-mounted winged pedestals 13 and a top-mounted winged pedestal 15. The mounting fixtures, both top and side, form winged pedestals having wings on opposite sides which are slidably engaged by grooved bases 17 and 19 respectively. The two vertical edges of the side-mounted winged pedestals 13 are equipped with square locking notches 13A and the four edges of the top-mounted winged pedestal 15 are equipped with locking notches 15A, explained hereinafter. The protective cap 11, shown here in the circular embodiment having a circular cap and cylindrical sides, also has window cut-outs 18 located along the lower portion of the cylindrical skirt surface for spring clips (further depicted hereinafter) which attach the cap to a post or piling.

The square top-mounted winged pedestals 15 and trapezoidal-shaped side-mounted winged pedestals 13 provide attachment points for various top or side-mounted accessories. A representative accessory for top mounting is a rope cleat block 16 which is attached to top-mounting pedestal grooved base 17. A representative accessory for side-mounting is a rope hook 20 attached to side mounting grooved base 19. Although various shapes may be used, within the scope of the invention, for both the top-mounted and the side mounted grooved bases, the square top and trapezoidal side grooved bases provide special features. The square top mounting grooved base allows installation of an accessory in four directions, thereby allowing the owner to orient a particular accessory to meet his preferences. The side-mounted trapezoidal grooved base, in contrast, can be mounted in only one orientation, the trapezoidal-winged pedestals being mounted with the short parallel side at the upper position. The feature prevents improper installation and adds additional vertical support to the side mounting grooved base as the accessory load is supported both by the upper edge of the side-mounted winged pedestal 13 and by the angled wings on the vertical edges of the side-mounted winged pedestal 13.

Figure 2A:
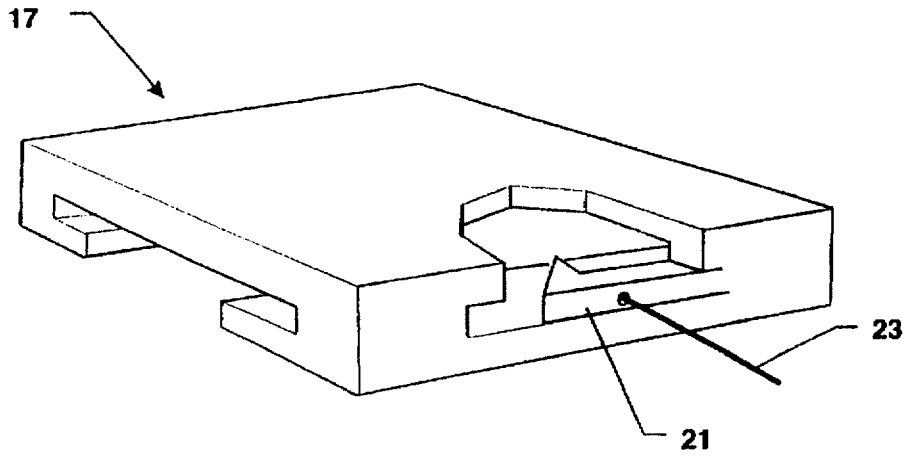
FIG. 2A is a perspective view of a medium strength grooved base for attaching top-mounted accessories such as birds of prey and spin wheels.

Operation of the top mounted grooved base 17 may be seen by reference to FIG. 2A. The grooved base 17, shown here without an attached accessory for clarity, slidably engages the top-mounted winged pedestals 15 of the protective cap 11 as previously described. During the initial engagement, a locking tab 21 integrally molded into base 17 is cammed outward by its sloped leading surface impinging on the edge of the pedestal wing. The locking tab is of suitable length and design to provide a spring action where it joins the grooved base 17. When fully engaged, the locking tab 21 (located on both sides of the base) snaps into the locking notch 15A, thereby locking the grooved base 17 to the top-mounted winged pedestal 15. A release pull 23 is attached to each locking tab 21 so that the mounting base can be unlocked for removal from the pedestal. In the event that a more permanently-locked installation is necessary, the release pull can be cut off and discarded. In that configuration, it is necessary to pry the locking tab 21 away from the winged pedestal with a screw driver or other implement in order to unlock the grooved base 17. The side-mounted grooved bases 19 are configured in the same manner having locking tabs and small releases on each side to communicate with the locking notches 13A of the side-mounted winged pedestals 13.

Figure 2B:
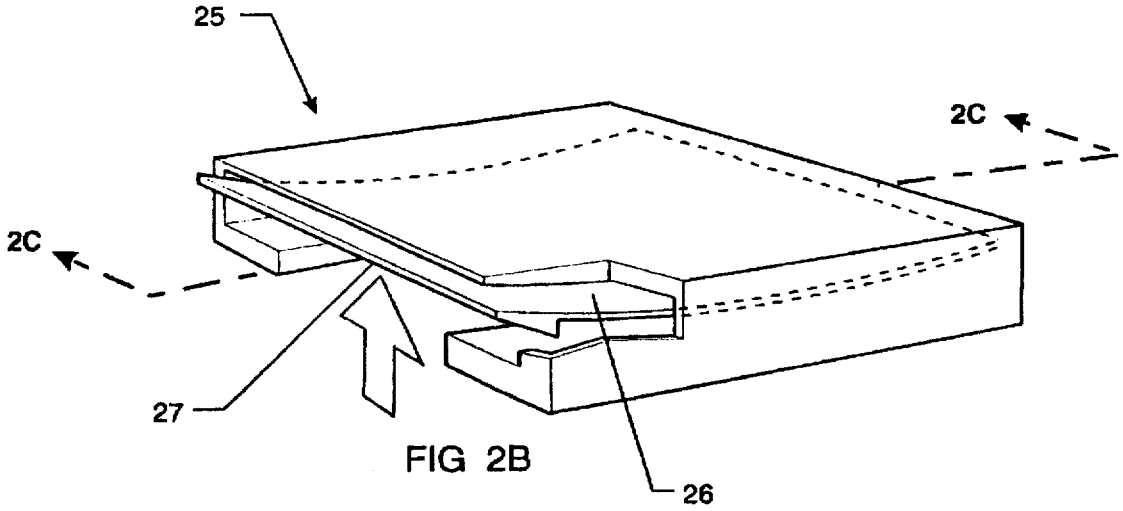
FIG. 2B is a perspective view of a high strength grooved base for attaching top-mounted accessories such as rope cleat blocks and rope railing blocks.
Figure 2C:
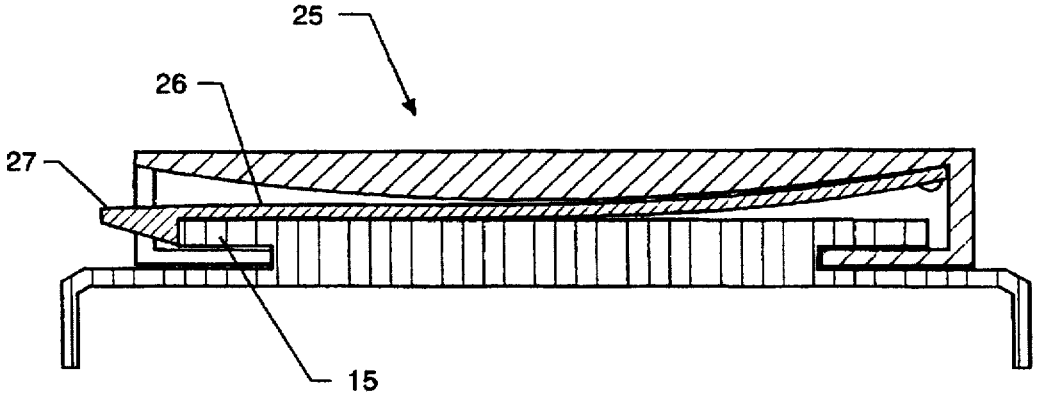
FIG. 2C is a cross-section of the high strength grooved base.

The grooved mounting base 17, with side locking tabs 21, provides a very strong mount suitable for most top mounted accessories. However, in the situation where a load force is applied directly against the locking tabs 21, the base does not provide sufficient strength for boat mooring and rope railings. In those cases, it is necessary to provide full strength in all directions. Referring now to FIG. 2B, an alternate embodiment of the grooved top mounting base 25 is shown. The alternate grooved base 25 has an internal, full-width locking tab 27 which snaps down along the entire width of the winged pedestal 15. The full-width locking tab 27 can be unlatched by lifting its leading edge. The full-width locking tab 27 is fabricated using a thin sheet of stainless steel 26. Alternately a high strength plastic, such as a polycarbonate, may be used. FIG. 2C shows the full-width locking tab 27 in the locked position extending along the edge of the top-mounted winged pedestals 15.

Figure 3:
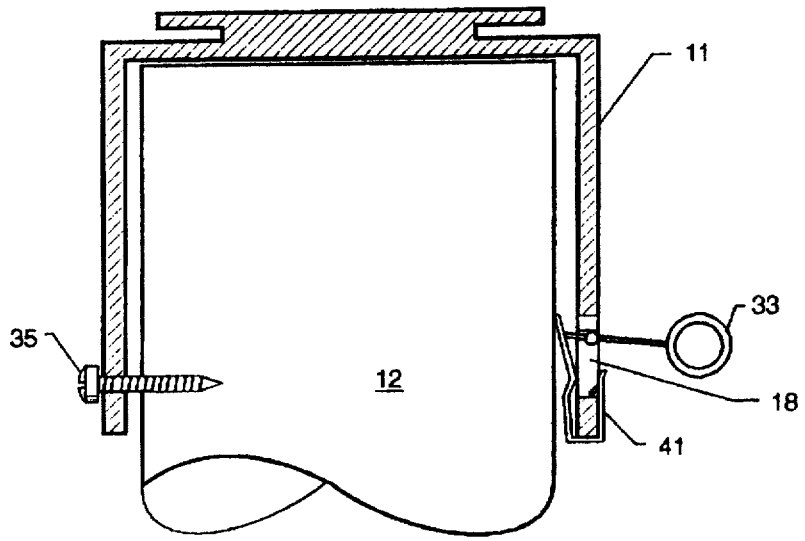
FIG. 3 is a sectional view of the post cap showing a J-clip and a screw or nail fastener.

Referring now to FIG. 3, attachment of the protective cap 11 to a post or piling may be more fully understood. The cap 11 is held in place by a spring clip 41 clipped to window cut-outs 18. The spring clip is a J-clip design having a clip release ring 33 which allows easy removal of the protective cap from a post or piling. Alternatively, screws 35 or other fasteners may be used to attach cap 11 to post 12.

Figure 3A:
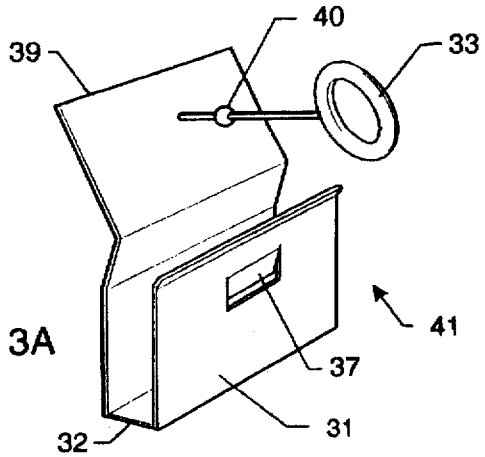
FIG. 3A is a perspective view showing details of the J-clip.
Figure 3B:
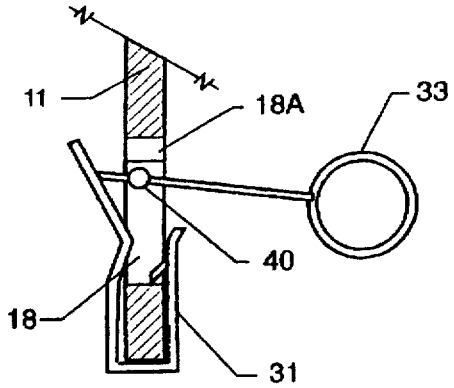
FIG. 3B is a cross-sectional view of a portion of the post cap skirt showing operation of the J-clip in the engaged position.

The specific details of the spring clip 41 are depicted in FIGS. 3A and 3B. The lower loop 32 of the "j" slips over the lower edge of the protective cap 11. The punched in tab 37 located in the J-clip outer face 31 of clip 41 serves as a lock to hold the clip to the cap by protruding into one of the window cut-outs 18. The upper edge 39 of the "J" provides an intimate contact with the post or piling thereby securing the entire assembly. The release ring 33 provides for removal as previously discussed.

Figure 4:
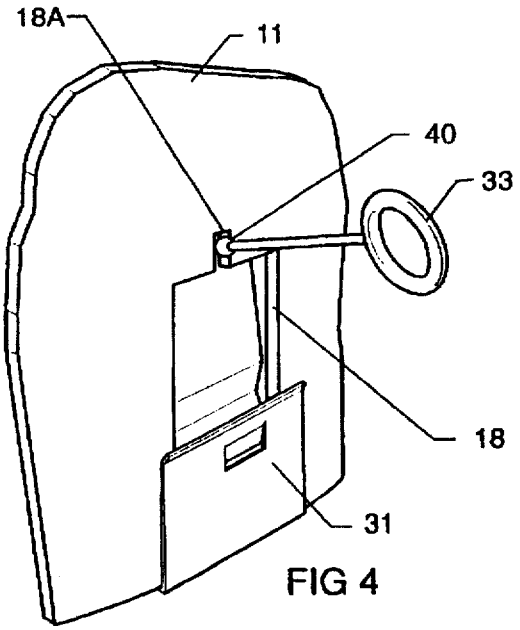
FIG. 4 is a perspective view of the J-clip in the non-engaged position.
Figure 4A:
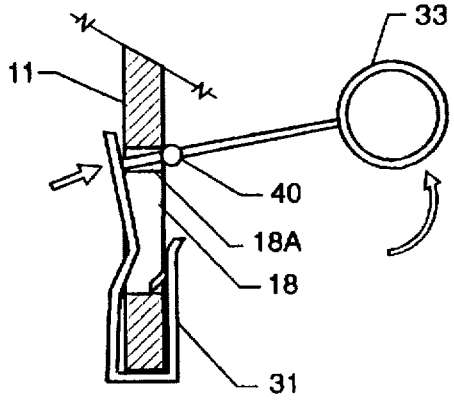
FIG. 4A is a cross-sectional view of a portion of the post cap skirt showing the J-clip in the non-engaged position.

A perspective of a portion of cap 11 is shown in FIG. 4 with the spring release ring 33 latched in the deactivated position holding the spring clip away from engagement with a piling. The operation to deactivate the spring the clip may be seen in FIG. 4A. The clip release ring 33 allows the spring clip to be locked in the non-engagement position by latching the ball 40 into a locking slot 18A at the upper edge of window cut-out 18.

Figure 5:
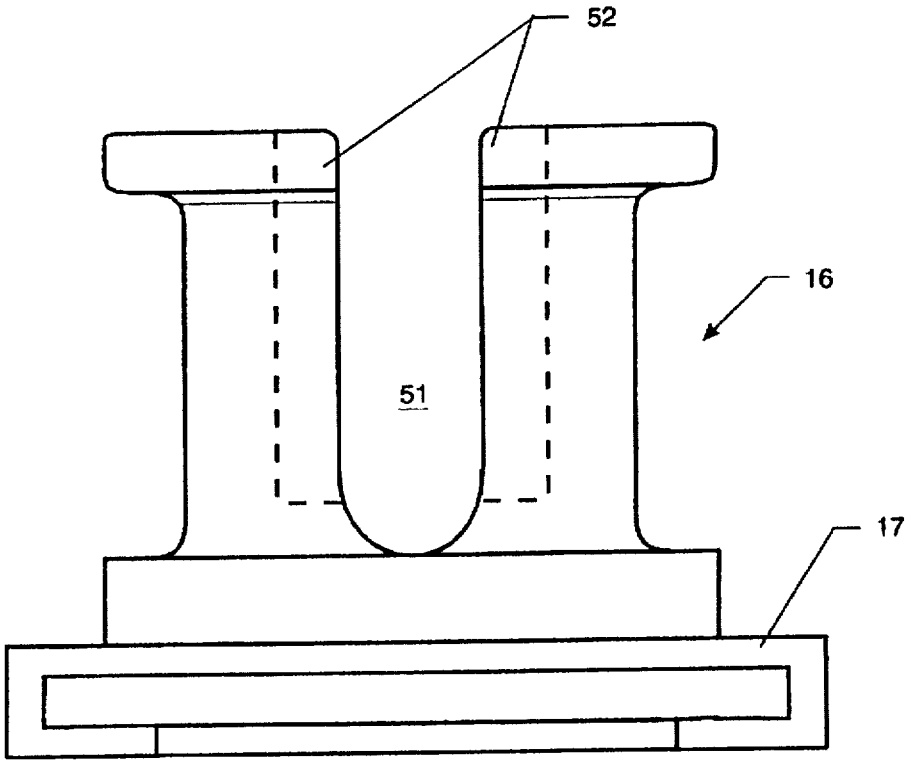
FIG. 5 is a side view of a rope cleat accessory.
Figure 6:
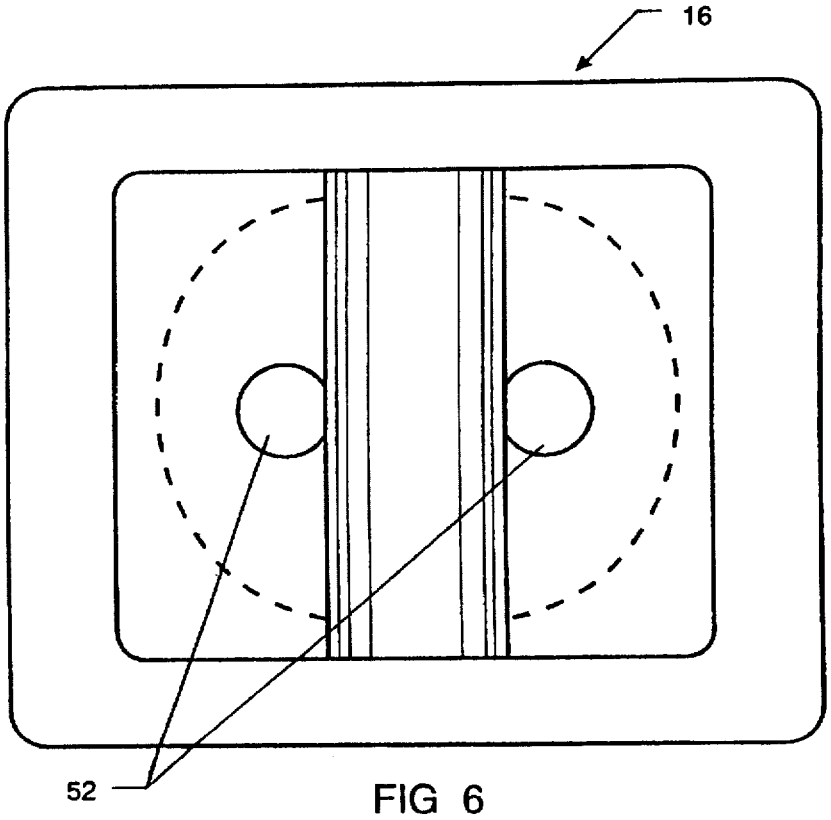
FIG. 6 is a top view of the rope cleat accessory.

Referring now to FIGS. 5 and 6, the specific construction of the rope cleat block 16, as attached to grooved base 17, may be seen. A boat line or other rope may be cleated in the conventional known manner using the outer edges of the cleat and the inner slot 51. Two bored holes 52, are cut into the top surface of rope cleat block 16. These holes allow for the mounting of a spike, pennant, or spinner device useful for repelling sea gulls or other birds. It is desired to discourage birds from lighting on the caps and thereby avoid fouling of the lines with bird wastes. The holes are bored so as to slightly breach the interior wall of the slot, thereby allowing a natural drainage of water. As the water drains and does not accumulate in the holes 52, freezing damage is avoided and pennant stems can dry out more readily.

Figure 7:
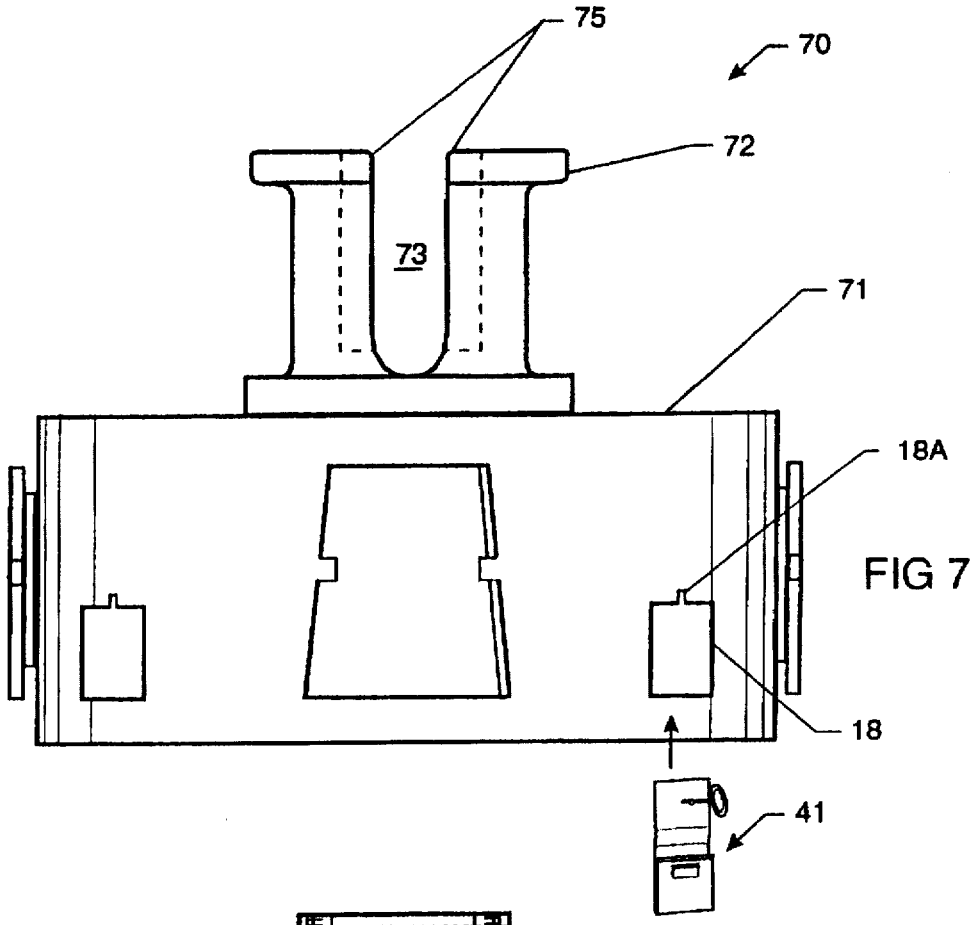
FIG. 7 is a side view of the cap and rope cleat assembly.
Figure 8:
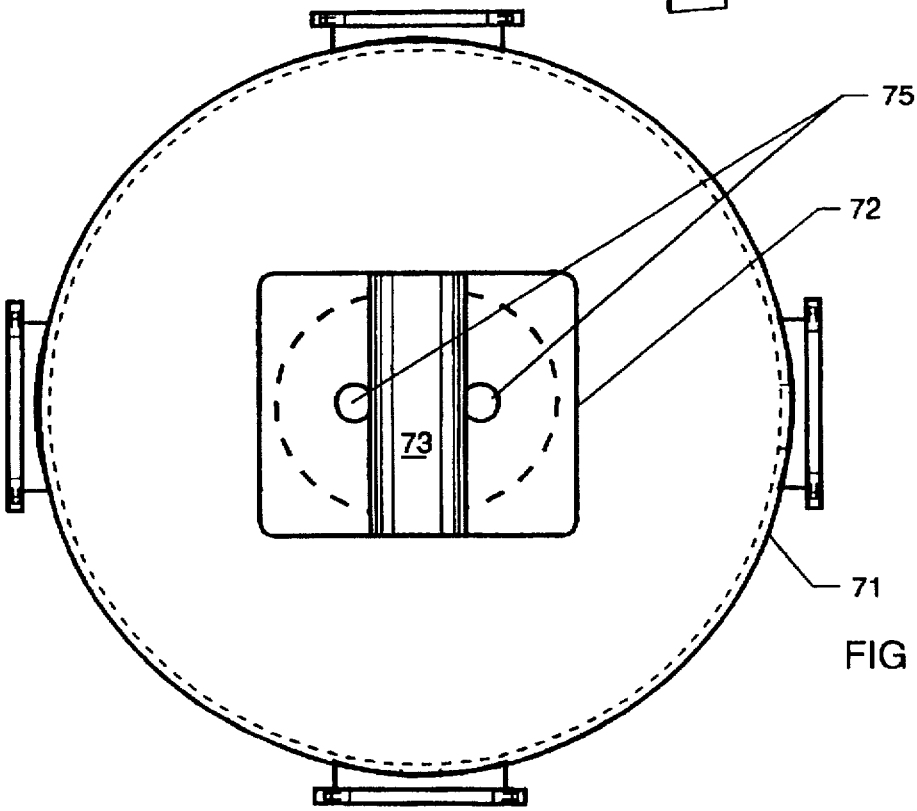
FIG. 8 is a top view of the cap and rope cleat assembly.

An alternate embodiment of the single unit cap and cleat assembly 70 is shown in FIGS. 7 and 8. In this embodiment, the cap 71 and dual-function rope cleat 72, having a inner slot 73, are integrally molded to form a single unit cap and cleat assembly 70. The window cut-outs 18 for attachment of J-clips 41 and locking slots 18A are the same as previously described. Likewise, attachment of the accessories requiring bored holes 75 are as previously described. Further attachment is accomplished by engaging a cleat-engaging base to the dual-function rope cleat 72, an explanation of which follows.

Figure 9:
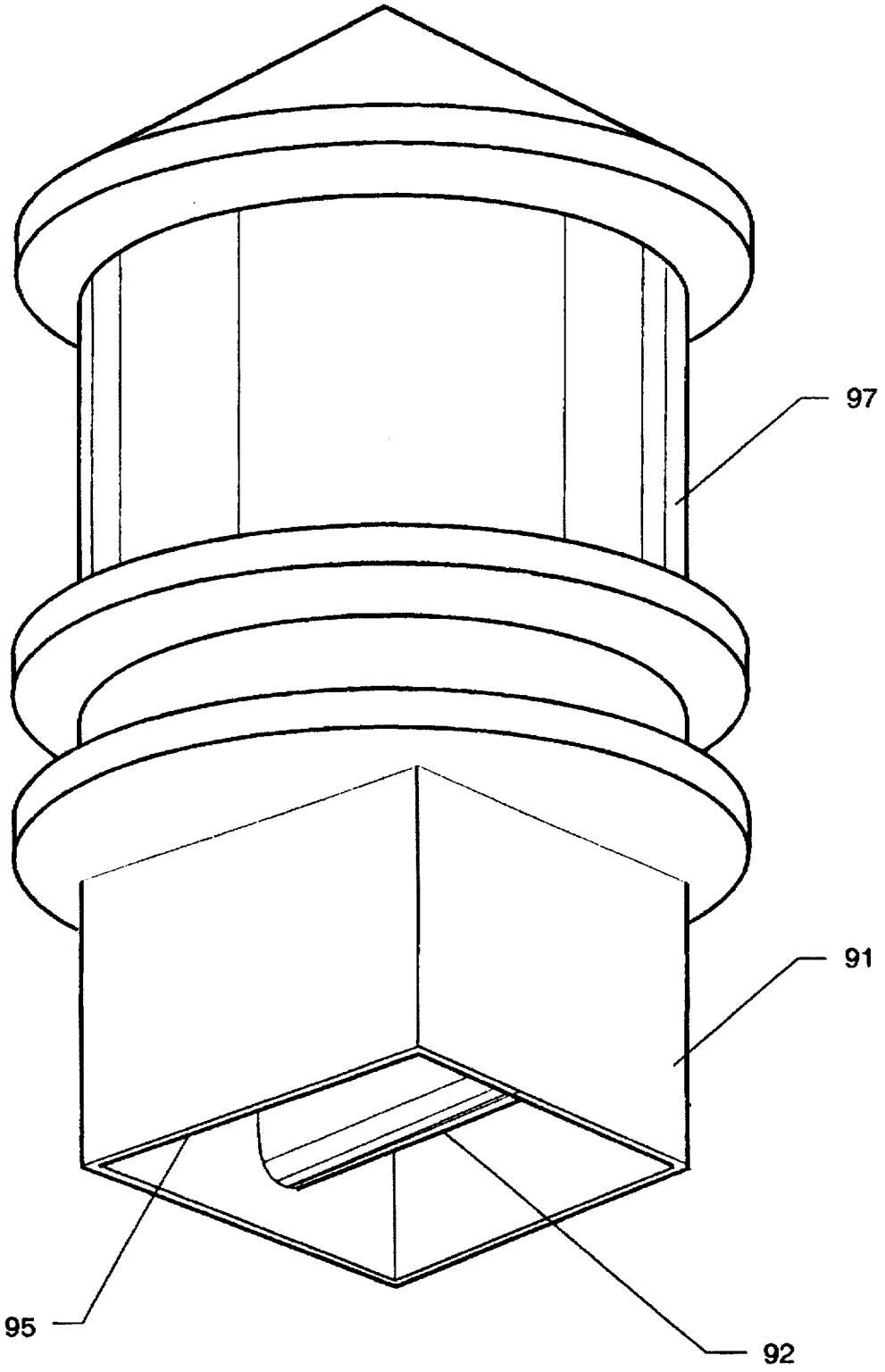
FIG. 9 is a perspective view of a lamp with a cleat-engaging base.

Referring now to FIG. 9, the cleat-engaging base 91 attached to a lamp 97 is shown from a lower perspective. The base 91 forms a hollow square tube with a configuration having a saddle center 92 which slidably engages the dual-function rope cleat 72 and slot 73 (shown in FIGS. 7 and 8). The outer edges 95 of the square tube slide over the outer surface of cleat 72, the entire mechanism being secured by a friction fit. Shown as a representative sample of accessories is a solar lamp 97.

Figure 10A:
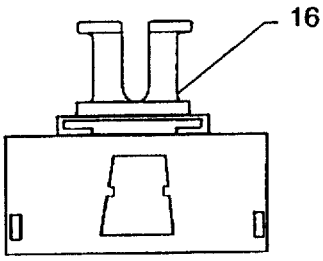
FIG. 10*a* is a piling cap and rope cleat assembly.
Figure 10B:
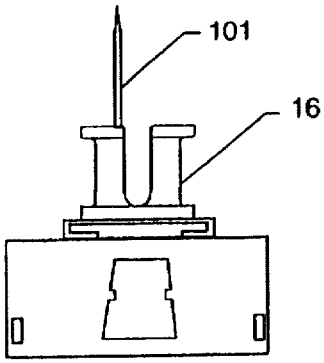
FIG. 10*b* is a spike attached to the cap and rope cleat assembly.
Figure 10C:
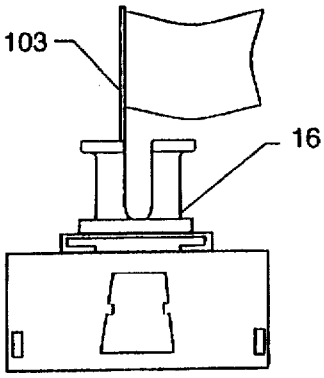
FIG. 10*c* is a pennant attached to the cap and rope cleat assembly.
Figure 10D:
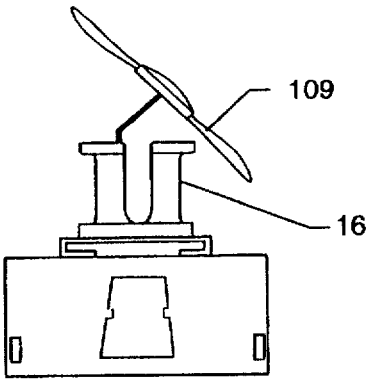
FIG. 10*d* is a bird-repelling spinner attached to the cap and rope cleat assembly.
Figure 10E:
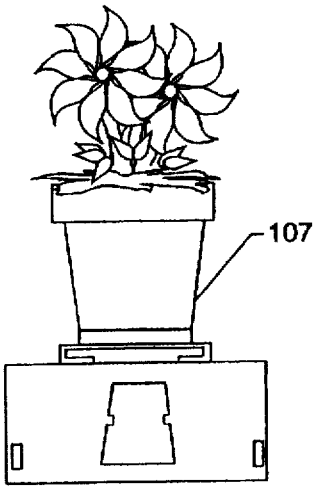
FIG. 10*e* is a decorative flower pot attached to the cap.
Figure 10F:
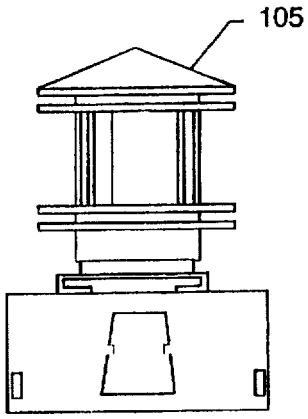
FIG. 10*f* is a solar-powered lamp attached to the cap.
Figure 10G:
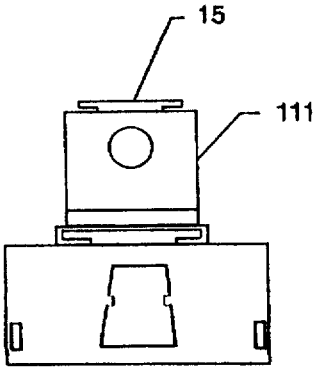
FIG. 10*g* is a rope guide block suitable for constructing a rope railing attached to the cap assembly.
Figure 10H:
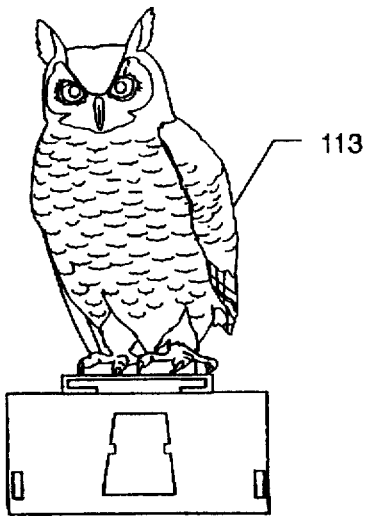
FIG. 10*h* is a bird repelling owl attached to said cap.

FIGS. 10*a–h* depict various configurations of the multi-purpose cap and accessory assembly. FIG. 10*a* shows the piling cap and rope cleat 16; FIG. 10*b* shows a spike 101 attached to rope cleat 16; FIG. 10*c* shows a pennant 103 attached to rope cleat 16; FIG. 10*d* shows a bird-repelling spinner 109 attached to rope cleat 16; FIG. 10*e* shows a decorative flower pot 107; FIG. 10*f* shows a solar-powered light 105; FIG. 10*g* shows a rope guide block 111 suitable for attaching a rope railing and is equipped with a top-mounted winged pedestal 15 for mounting additional accessories; FIG. 10*h* shows a bird repelling owl 113. Each of the above-listed accessories may be mounted to either protective cap embodiment of the invention by using the appropriate base.

Figure 11:
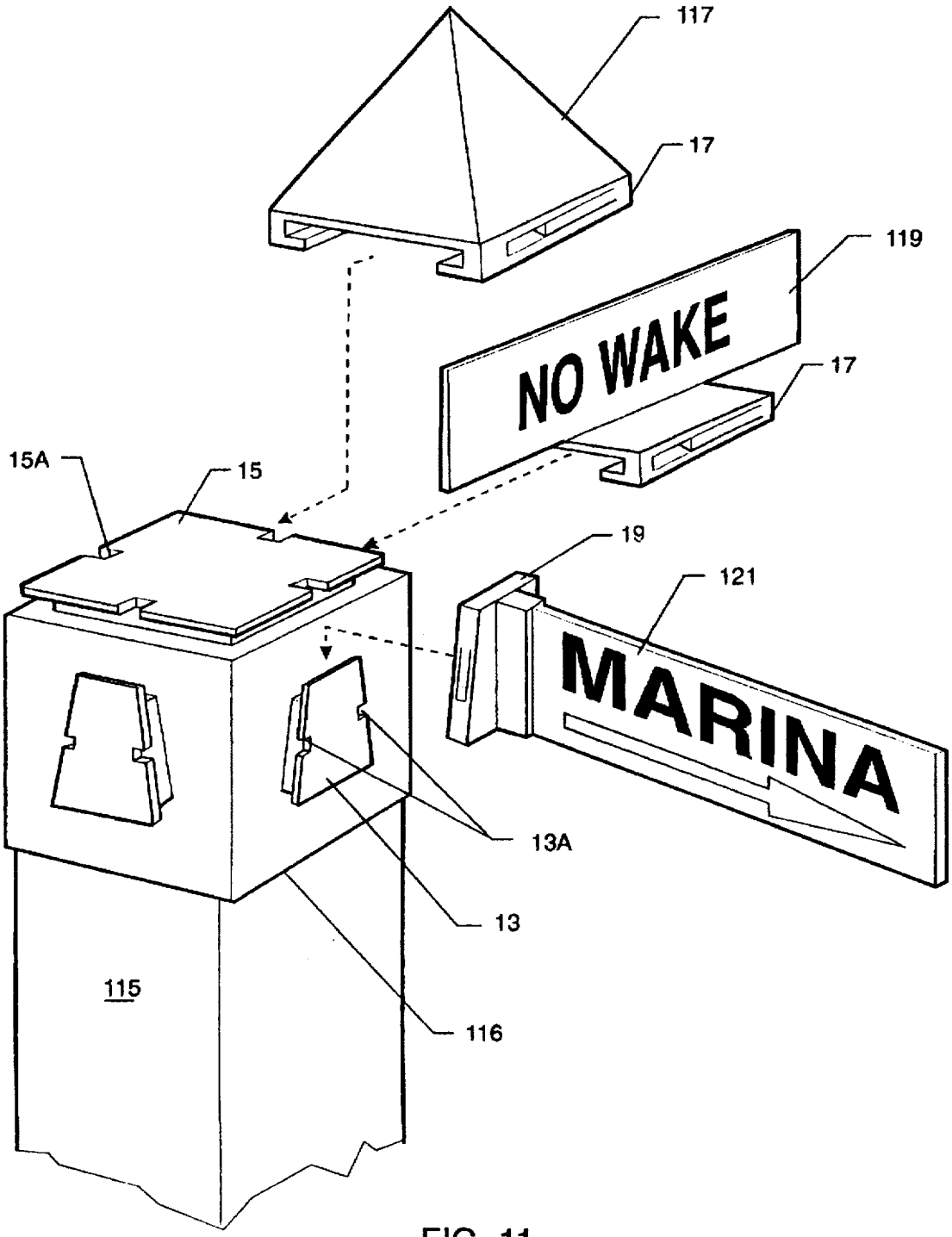
FIG. 11 is an exploded view showing the post cap adapted to a square post with several accessories.

Referring now to FIG. 11, an alternate embodiment of the protective cap 116 having a square top and rectangular sides is adapted for a square post 115. The grooved base 17, side bases 19, side-mounted winged pedestals 13 with square locking notches 13A, and top-mounted winged pedestal 15 with locking notches 15A are shown for reference. Accessories which have the previously described self-locking grooved bases include the pointed cap 117, a NO WAKE sign 119 and a MARINA direction indicator 121.

Figure 12A:
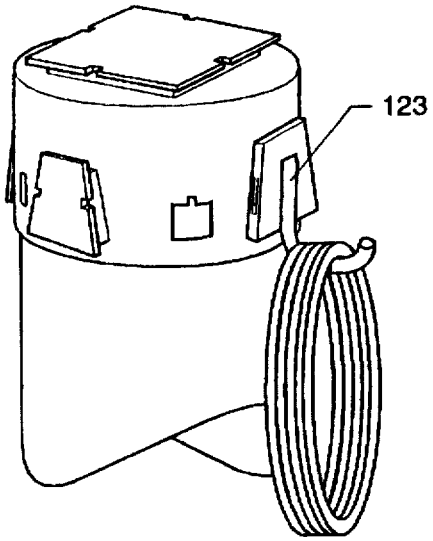
FIG. 12A is a perspective view of the post cap assembly with a hook for side mounting.
Figure 12B:
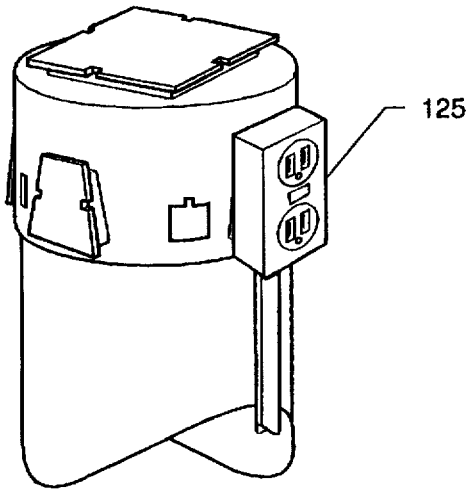
FIG. 12B is a perspective view of the post cap assembly with an electric outlet.
Figure 12C:
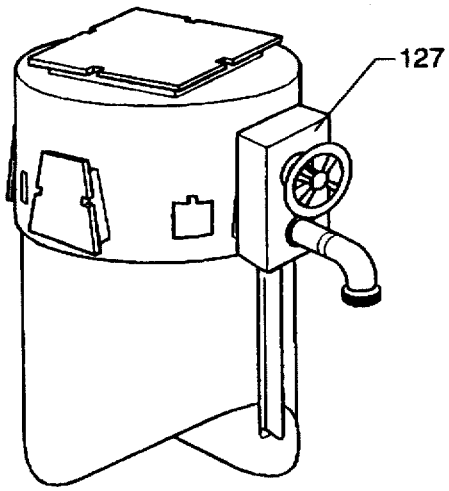
FIG. 12C is a perspective view of the post cap assembly with a water faucet.
Figure 12D:
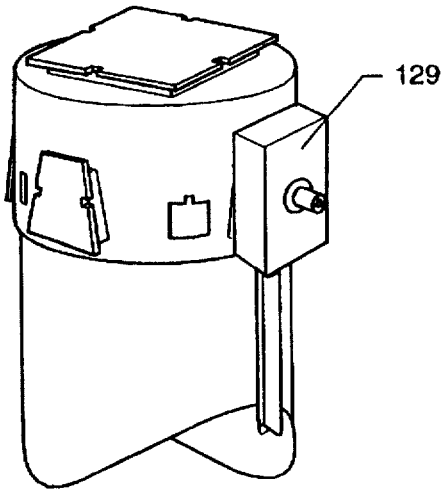
FIG. 12D is a perspective view of the post cap assembly with a television cable outlet.

Additional side-mounted accessories are depicted in FIGS. 12A–D. FIG. 12A shows a hook 123; FIG. 12B shows an electric outlet 125; FIG. 12C shows a water faucet 127 with water connections; and FIG. 12D shows a television cable outlet 129. Although not visible in FIGS. 12B, C and D, the previously disclosed grooved pedestal base 19 is attached to the rear side of all accessories.

Figure 13:
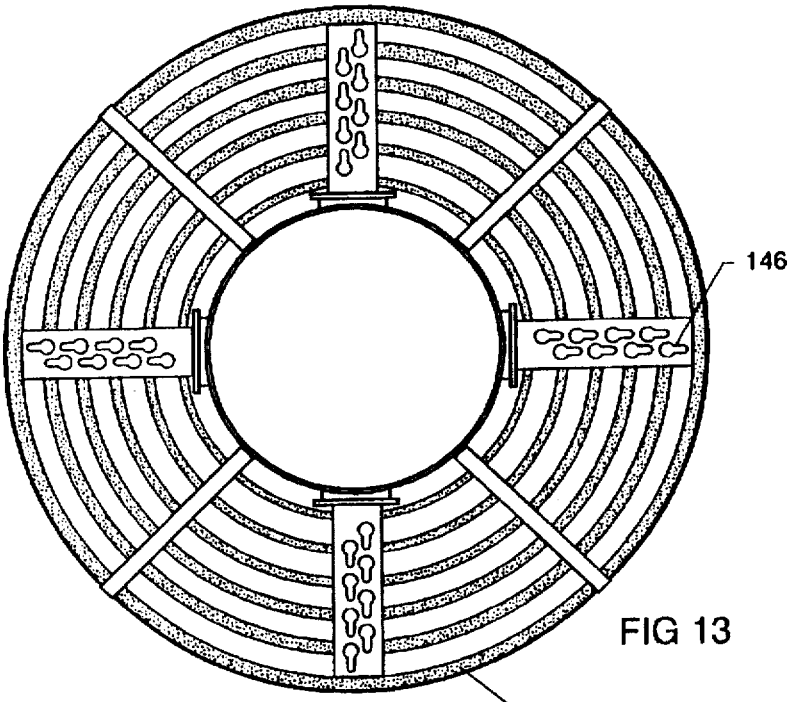
FIG. 13 is a top view of the post cap assembly with an osprey nest platform supported by a protective cap.
Figure 13A:
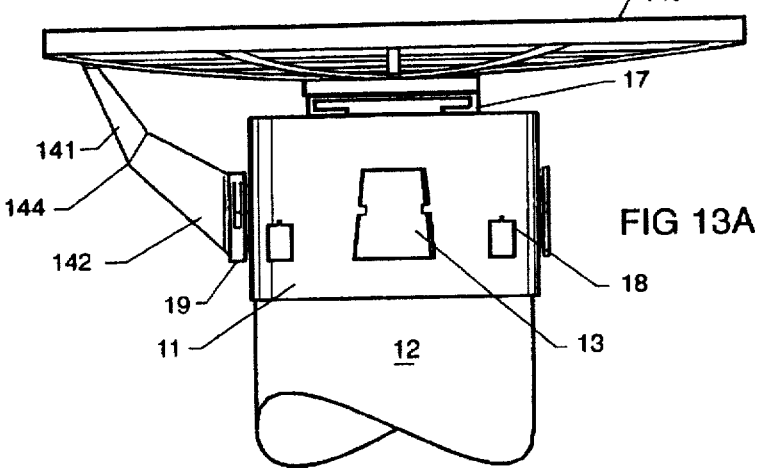
FIG. 13A is a side view of the post cap assembly with the nest platform supported by and attached to a protective cap.
Figure 13B:
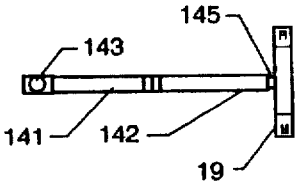
FIG. 13B is a top view of a support arm.
Figure 13C:
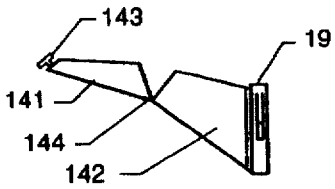
FIG. 13C is a side view of a support arm in an unlocked position.
Figure 13D:
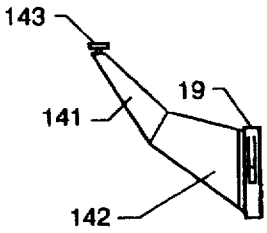
FIG. 13D is a side view of a support arm in a locked position.

Referring now to FIGS. 13 and 13A, a large osprey nesting platform 140 is attached to a piling 12. The top mounting grooved base 17, side-mounted winged pedestal 13, side mounting grooved base 19, window cut-outs 18 and protective cap 11 are shown for reference. FIGS. 13B and 13C depict a hinged support bracket consisting of a T-shaped stud 143, an upper arm 141, a connecting off-center hinge 144 and a lower arm 142 attached to a side mounting grooved base 19. The portion 145 of lower arm 142 immediately adjacent to side mounting grooved base 19 is reduced in thickness to provide flexibility. The stud 143 is first inserted into one of the slotted holes 146, secondly the grooved base 19 is attached to its respective side-mounted winged pedestal 13 and thirdly the upper arm 141 and lower arm are pulled downward to achieve a locked position utilizing the off-center hinge as shown in FIG. 13D. A series of slotted holes 146 is provided to accommodate the varying diameters of protective cap 11.

The novel features and benefits of the present invention are numerous. The multi-purpose cap provides a waterproof sealed upper surface while allowing attachment of a variety of accessories to the top surface. There is no breaching of either the cap or the treated piling top surface. Additionally, any number of top or side-mounted accessories may be easily and quickly installed or removed. By combining avian repelling accessories with other rope engaging accessories, such as the rope cleat and rope hook, it is possible to maintain clean and unfouled lines. Other simple combinations allow the attaching of rope rails or lighting fixtures.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A protective cap and accessory assembly for posts and pilings comprising;

a protective cap having a plurality of winged mounting pedestals, said winged mounting pedestals comprising:

a top-mounted square-sided pedestal having wings on each of the sides, and a plurality of side-mounted winged pedestals, and a plurality of accessory mounting bases having a pair of grooves, and a plurality of accessories attached to said mounting bases.

2. A projective cap assembly as in claim 1 wherein said plurality of winged mounting pedestals including a top mounted winged pedestal further comprises side-mounted trapezoidal-shaped pedestals having wings on all sides, said trapezoidal pedestals being oriented with a short parallel side in an upper position.

3. A protective cap assembly as in claim 1 wherein the grooved mounting bases slidably engage the said winged pedestals.

4. A protective cap assembly as in claim 1 wherein said plurality of accessory mounting bases having grooves have a locking tab located on one or both of the sliding grooves.

5. A protective cap assembly as in claim 4 wherein said locking tab has a release pull attached to said tab.

6. A protective cap assembly as in claim 4 wherein the wings of the winged mounting pedestals are equipped with notched cutouts for accepting the locking tabs of the accessory grooved bases.

7. A protective cap assembly as in claim 1 wherein said plurality of mounting bases with grooves have a wide locking tab attached by means of a flexible sheet of material to each grooved base, said locking tab engaging a farthest edge of the winged mounting pedestal upon closure or full travel of the grooved mounting base onto the winged pedestal, and said locking tab being releasable by the lifting of the tab.

8. A protective cap assembly as in claim 1 wherein said protective cap having a top-mounted, square-sided, winged pedestal is manufactured by the casting of metal or the molding of a plastic.

* * * * *